US010633886B2

(12) United States Patent
Garrett

(10) Patent No.: US 10,633,886 B2
(45) Date of Patent: Apr. 28, 2020

(54) REMOVABLE FENCE

(71) Applicant: Erroll Garrett, Bayton, TX (US)

(72) Inventor: Erroll Garrett, Bayton, TX (US)

( * ) Notice: Subject to any disclaimer, the term of this patent is extended or adjusted under 35 U.S.C. 154(b) by 369 days.

(21) Appl. No.: 15/808,770

(22) Filed: Nov. 9, 2017

(65) Prior Publication Data

US 2019/0136574 A1 May 9, 2019

(51) Int. Cl.
*E04H 17/18* (2006.01)
*E04H 17/14* (2006.01)

(52) U.S. Cl.
CPC ..... *E04H 17/18* (2013.01); *E04H 17/1421* (2013.01); *E04H 2017/1452* (2013.01)

(58) Field of Classification Search
CPC ..... E04H 17/1439; E04H 17/1443; E04H 17/1426; E04H 17/1491; E04H 17/1421; E04F 11/18; E04F 11/181; E04F 11/1834
See application file for complete search history.

(56) References Cited

U.S. PATENT DOCUMENTS

| | | | | |
|---|---|---|---|---|
| 3,140,858 | A | 7/1964 | Westphal | |
| 4,046,261 | A | 9/1977 | Yake | |
| 4,521,006 | A | 6/1985 | Waters | |
| 4,951,925 | A * | 8/1990 | Schultz | E04H 17/1421 256/22 |
| 4,982,933 | A * | 1/1991 | Schultz | E04H 17/1421 256/22 |
| 4,986,513 | A * | 1/1991 | Schultz | E04H 17/1421 256/22 |
| 6,149,135 | A | 11/2000 | Hlavin | |
| 6,540,209 | B2 | 4/2003 | Ross | |

* cited by examiner

*Primary Examiner* — Daniel J Wiley

(57) ABSTRACT

The invention is directed to a removable fence. The fence is designed to be sturdy and reliable, while remaining quickly and easily removable without the use of tools. The fence provides two or more fenceposts and one or more fence sections. Threaded lockbars and wingnuts are provided for each fence section. The lockbars and wingnuts may be used to temporarily affix the end of the fence section to the fencepost. A plurality of fenceposts and fence sections may be erected and joined in this manner to construct the fence. The process may be reversed to remove the fence sections from the fenceposts to prepare for an approaching storm.

3 Claims, 4 Drawing Sheets

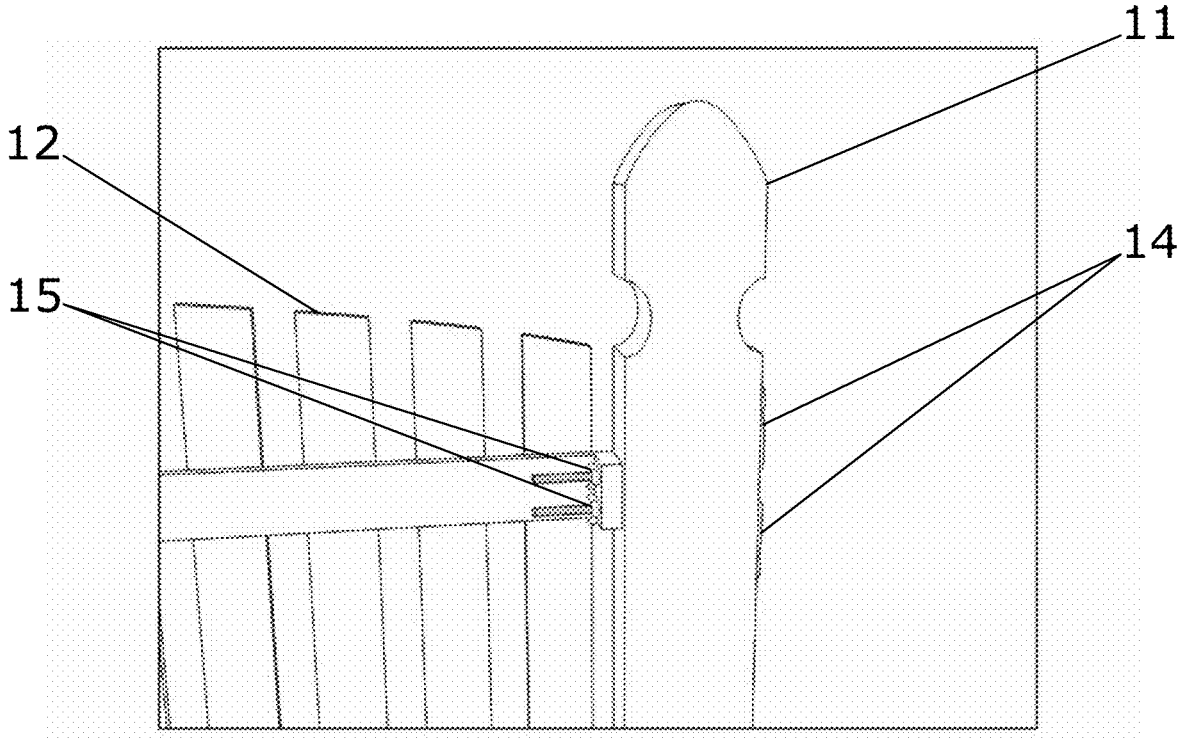
FIG.7
FIG.8
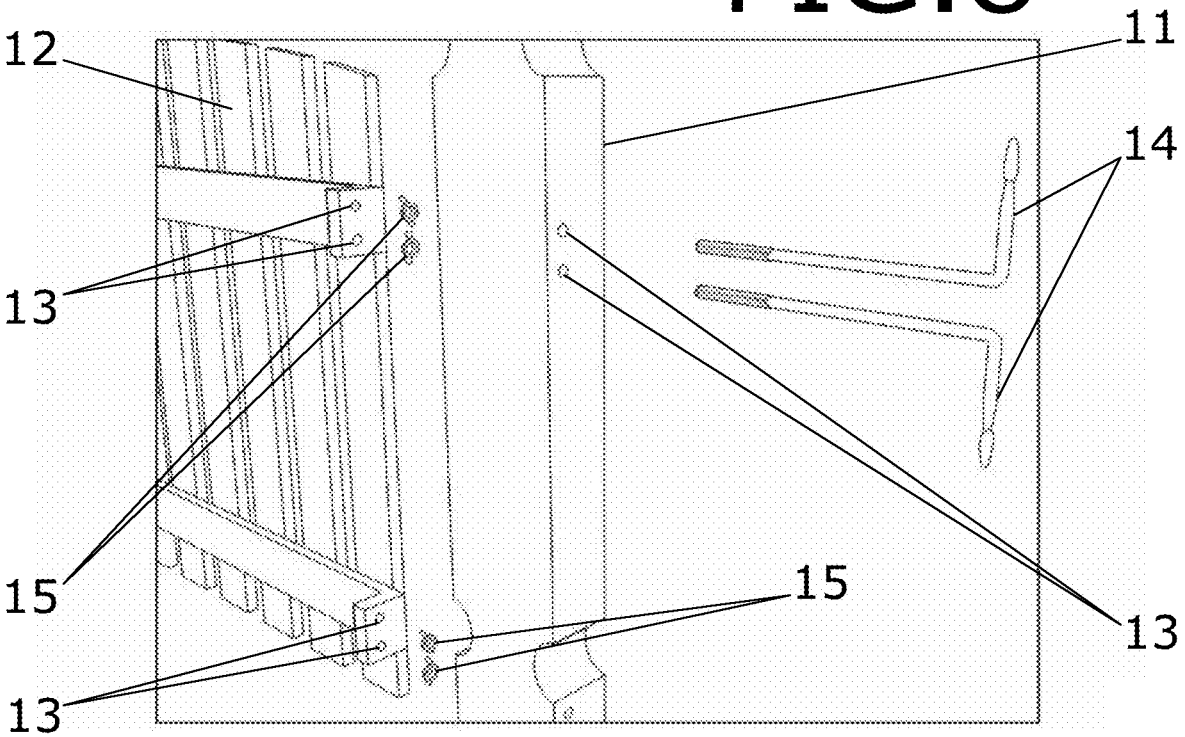

REMOVABLE FENCE

CROSS-REFERENCE TO RELATED APPLICATIONS

This application claims the benefit of Provisional Patent Application No. 62/419,931, filed Nov. 9, 2016 which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to fences and fencing materials, and in particular to a removable fence. A tornado, hurricane, tropical storm, or other wind storm can cause catastrophic damage and injuries due to wind force. The second greatest cause of damage and injury is debris that has been picked up and propelled by the wind. After the storm has passed, the debris must be cleaned up. In many cases, structures which were built to withstand the wind are damaged or destroyed by debris, which may include roofing materials, traffic signs, and fencing materials. Any outdoor structure which can be quickly and easily taken down and securely stored will be safe from damage as well as being prevented from becoming damaging debris itself, and would be well received.

A search of the prior art reveals various devices which have been developed to provide a removable fence or barrier. None are closely related to the present invention, but several include features which resemble those of the present invention. Each has proven to be less than satisfactory for the present purpose in its own way.

Removable fence for table saw, U.S. Pat. No. 4,521,006 (filed Jan. 24, 1983), provides a removable fence which is positioned on a saw table by a locking mechanism located on the fence. The locking mechanism simultaneously grips a pair of blocks mounted on an endless flexible cable. The locking mechanism engages the blocks and raises them into frictional relation with an L-bracket mounted on the table thus preventing movement of the fence. The blocks are affixed to the cable at points equidistant from the plane of the saw blade, thereby insuring parallelism of the fence relative to the plane of the saw blade. Utilizing the flexibility of the cable which permits lateral movement, the fence is removed by releasing the locking mechanism and moving the blocks laterally away from the mechanism.

Dishwasher rack, U.S. Pat. No. 4,046,261 (filed Feb. 5, 1976), provides a rack structure for an automatic dishwasher. The rack structure comprises a plurality of wire members welded together to form a rectangular, openwork rack having a bottom, upstanding front and rear walls and upwardly and outwardly sloping side walls. At least one pair of removable fences is provided, each fence comprising a plurality of upstanding wire members with a horizontal wire member welded thereto and spaced upwardly from the bottom ends thereof. Means are provided to removably mount the fences within the rack structure in parallel spaced relationship to each other and to the rack structure side walls. The fence mounting means may be so configured as to provide more than one predetermined position in which each fence may be mounted, so as to render adjustable the distance between adjacent fences and the distance between each rack structure side wall and the adjacent one of the fences. Means may also be provided to lock each fence in its selected predetermined position in the fence mounting means. The wire members of the entire rack structure, including the removable fences, are coated with a protective plastic to prevent rust and corrosion thereof.

Portable pole systems for supporting fencing, game nets, rope line dividers, and for landscaping uses, and the like, U.S. Pat. No. 6,149,135 (filed Jan. 19, 1999), provides a movable pole system supporting divider material such as fencing, netting, or rope divider between a plurality of laterally spaced vertical poles orientated in a predetermined ground pattern. Each pole contains one or more connectors secured to the exterior surface of the pole for supporting the mesh material. Each connector includes a quick connect and disconnect mechanism comprising at least three outwardly extending elbows each with a vertically disposed arm. The upwardly extending vertical arms are in cooperative combination with the downwardly depending vertical arms to facilitate connection and disconnection of the fencing, provided the exterior vertical arms are opposed in direction to the intervening interior vertical arm.

Fence assembly, U.S. Pat. No. 3,140,858 (filed Aug. 24, 1962), provides a fence assembly including ground-anchored standards. The fence assembly has particular relation to an arrangement having a more-or-less permanent ground anchoring stake portion, which includes a socket adapted for easy insertion and removal of the above-ground portion of a post, so that, in one manner of use, gateways may be provided by easy removal of fence sections and posts.

Portable safety fence system for construction sites, U.S. Pat. No. 6,540,209 (priority Mar. 31, 2000), provides a safety fence system enabling users to easily attach, adjust, move, and remove safety railings at a construction site. The safety fence system includes a plurality of fence post brackets and a plurality of fence panels. The fence post brackets each connect to a concrete slab or other floor of a building under construction by a C-shaped clamp member. The fence panels, such as chain link fence panels, are easily connected to the fence post brackets by slipping tubular end posts of the fence panels over short pipes on the clamp member.

Some of the prior art inventions present certain disadvantages. The present invention has been developed for the purpose of addressing and resolving these disadvantages, by enabling the temporary removal of a fence as a wind storm is approaching. A removable fence, which provides threaded lockbars and wingnuts enabling users to quickly and easily remove sections of the fence from the fenceposts without the use of tools, would resolve this problem.

SUMMARY OF THE INVENTION

Accordingly, the invention is directed to a removable fence. The fence is designed to be sturdy and reliable, while remaining quickly and easily removable without the use of tools. The fence provides two or more fenceposts and one or more fence sections. Threaded lockbars and wingnuts are provided for each fence section. The lockbars and wingnuts may be used to temporarily affix the end of the fence section to the fencepost. A plurality of fenceposts and fence sections may be erected and joined in this manner to construct the fence. The process may be reversed to remove the fence sections from the fenceposts to prepare for an approaching storm.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serves to explain the principles of the invention.

FIG. 7 is a close-up rear perspective view of a portion of the first exemplary embodiment, displaying the fenceposts 11, the fence section 12, the lockbars 14, and the wingnuts 15.

FIG. 8 is a close-up exploded rear perspective view of a portion of the first exemplary embodiment, displaying the fence 10, the fenceposts 11, the fence section 12, the apertures 13, the lockbars 14, and the wingnuts 15.

DETAILED DESCRIPTION OF THE INVENTION

Figure 1:
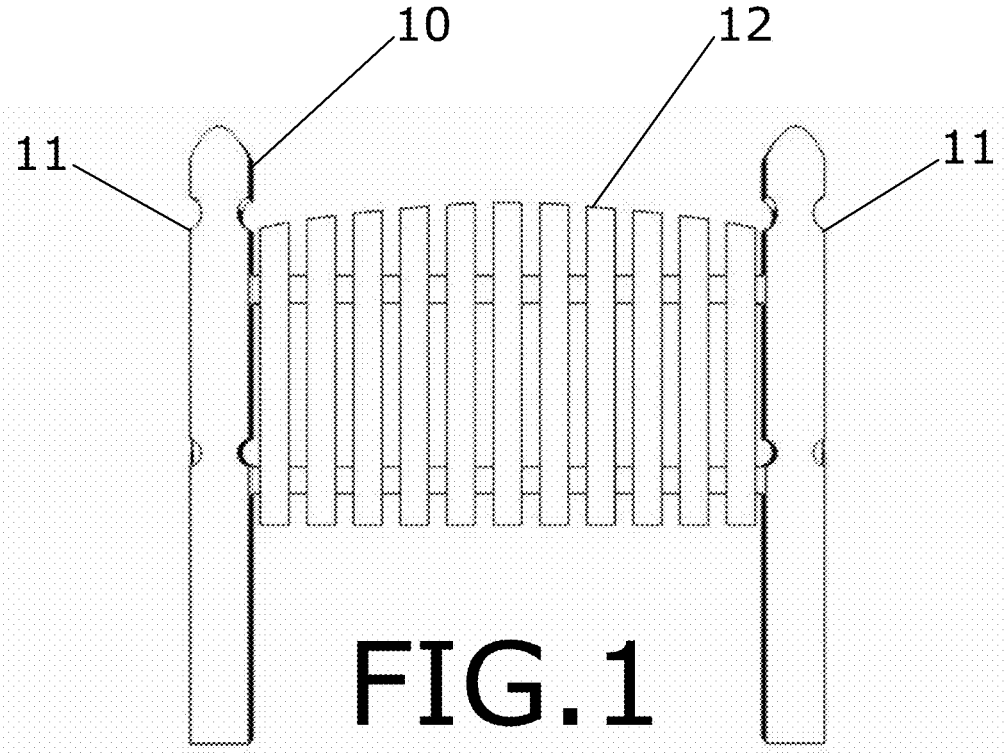
FIG. 1 is a front view of the first exemplary embodiment, displaying the fence 10, the fenceposts 11, and the fence section 12.
Figure 2:
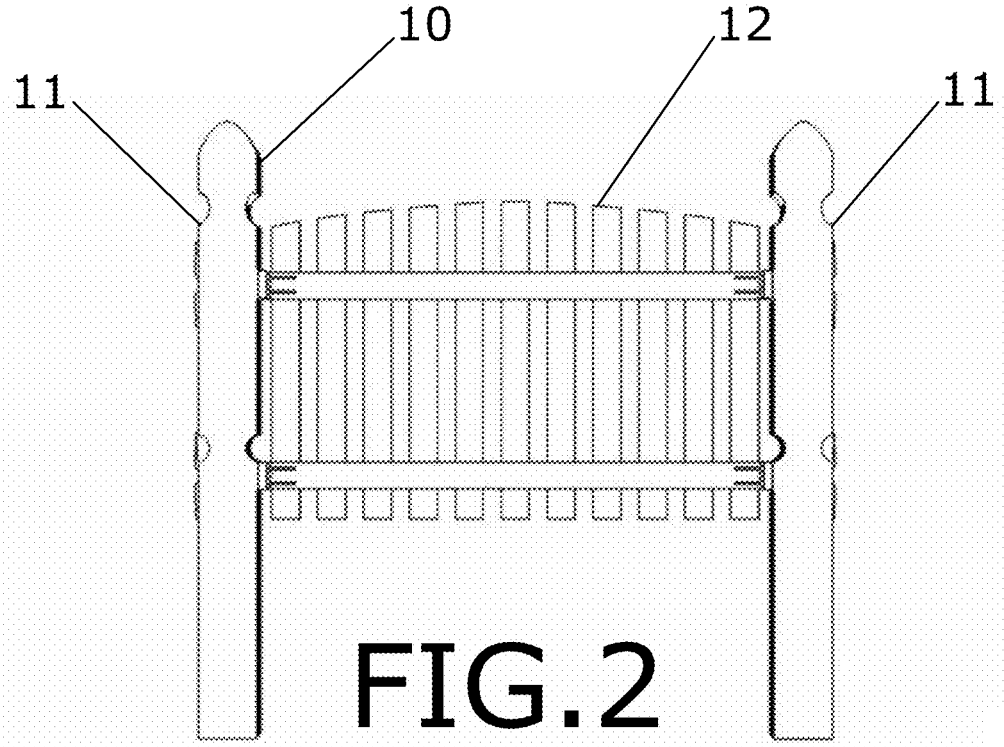
FIG. 2 is a rear view of the first exemplary embodiment, displaying the fence 10, the fenceposts 11, and the fence section 12.
Figure 3:
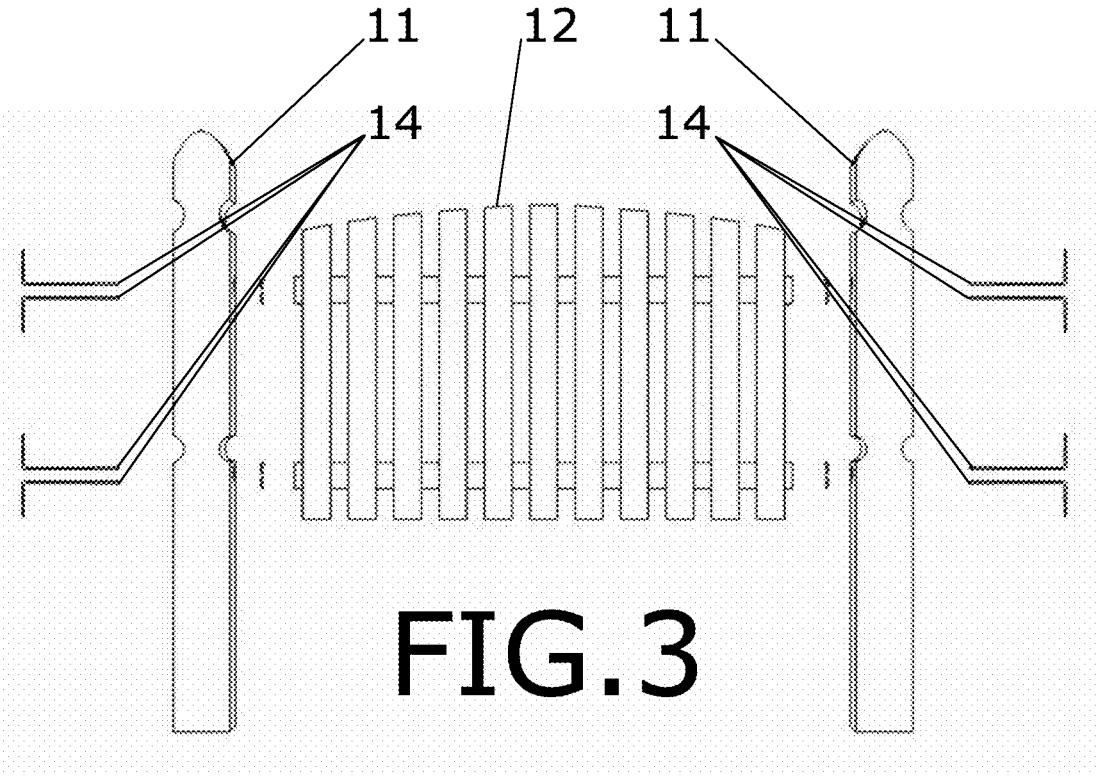
FIG. 3 is an exploded front view of the first exemplary embodiment, displaying the fence 10, the fenceposts 11, the fence section 12, and the lockbars 14.
Figure 4:
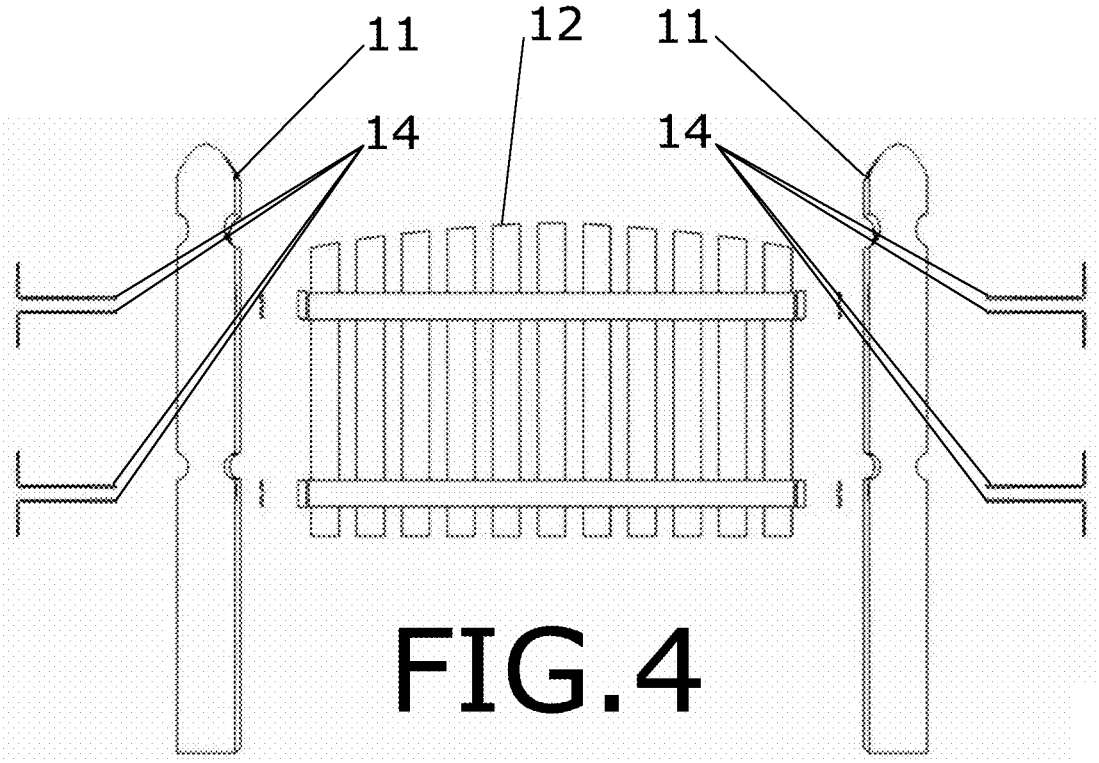
FIG. 4 is an exploded rear view of the first exemplary embodiment, displaying the fence 10, the fenceposts 11, the fence section 12, and the lockbars 14.
Figure 5:
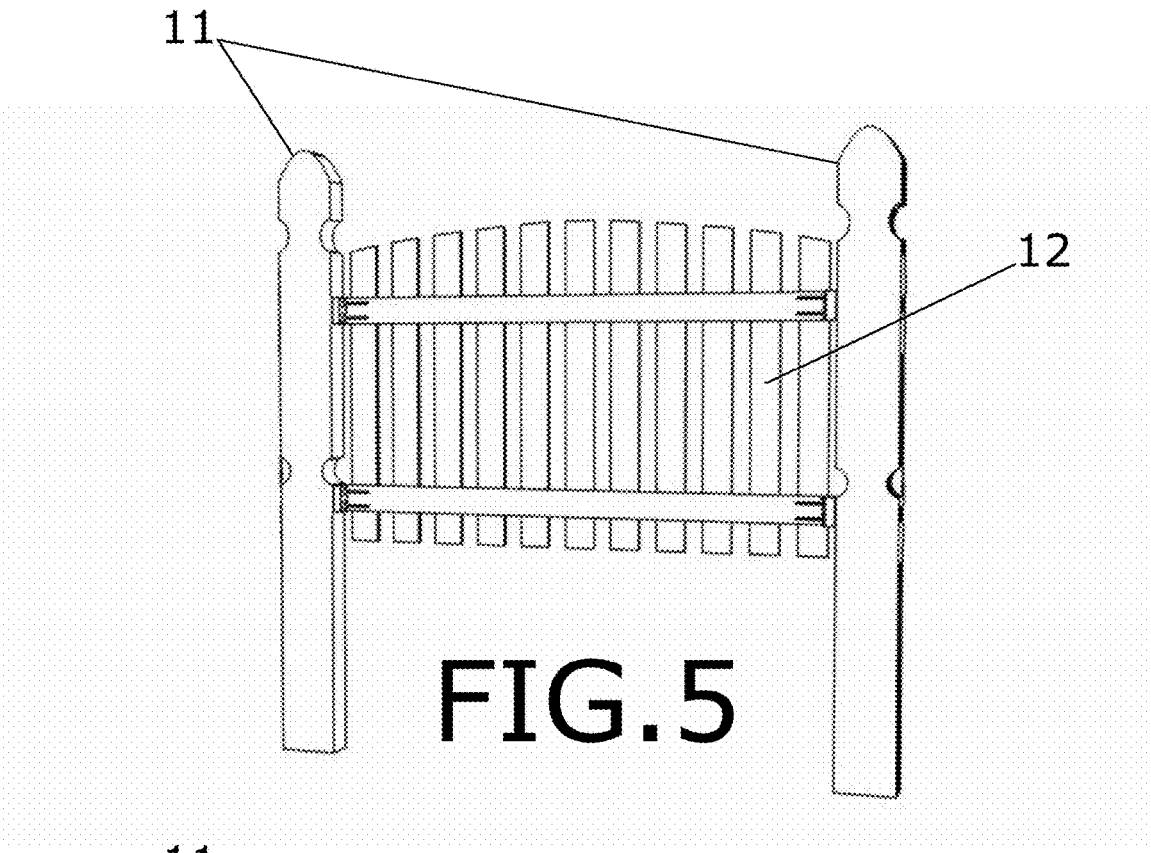
FIG. 5 is a front perspective view of the first exemplary embodiment, displaying the fence 10, the fenceposts 11, and the fence section 12.
Figure 6:
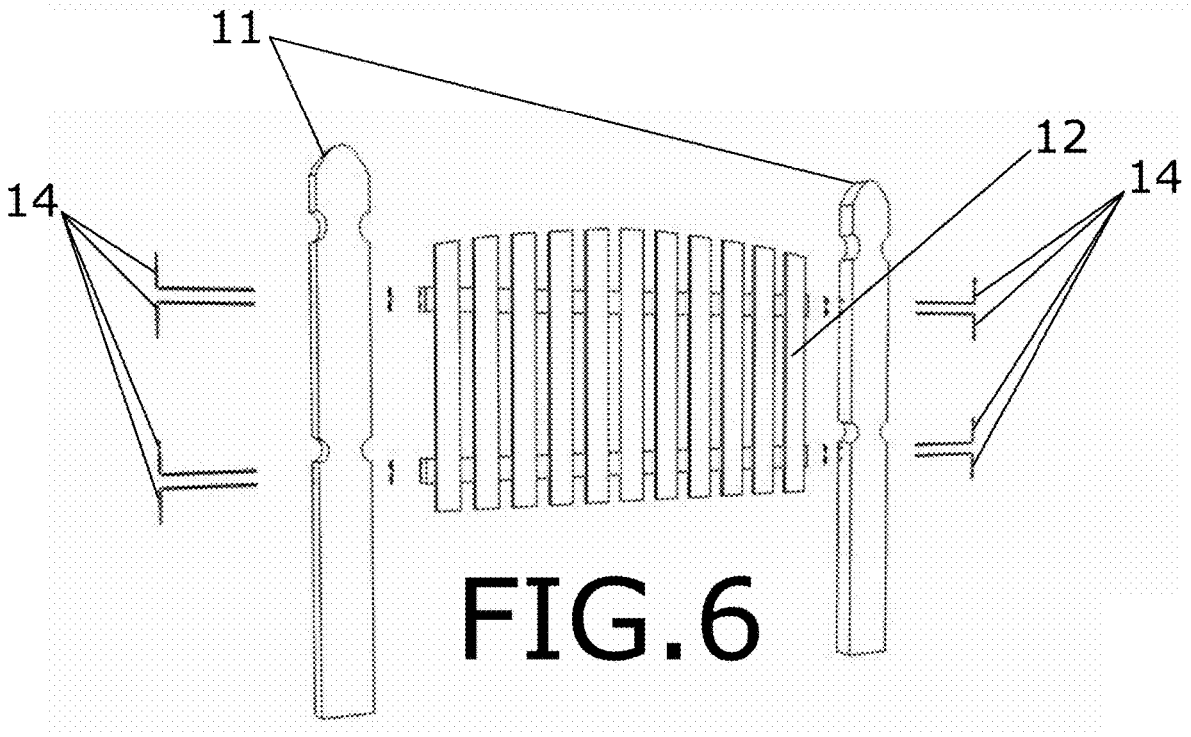
FIG. 6 is an exploded rear perspective view of the first exemplary embodiment, displaying the fence 10, the fenceposts 11, the fence section 12, and the lockbars 14.

Referring now to the invention in more detail, the invention is directed to a removable fence 10. The fence 10 is designed to be sturdy and reliable, while remaining quickly and easily removable without the use of tools.

The first exemplary embodiment is comprised of a fence 10 which provides two or more fenceposts 11 and one or more fence sections 12. Circular apertures 13 are provided in the fenceposts 11 and in the ends of the fence sections 12. Eight L-shaped, threaded lockbars 14 and eight wingnuts 15 of a corresponding size are provided for each fence section 12. The lockbars 14 may be inserted through the apertures 13 of a fencepost 11 and a fence section 12, and the wingnuts 15 affixed to and tightened upon the threads of the lockbars 14, in such a manner as to temporarily affix the end of the fence section 12 to the fencepost 11.

A plurality of fenceposts 11 and fence sections 12 may be erected and joined in this manner to construct the fence 10. The process may be reversed to remove the fence sections 12 from the fenceposts 11 to prepare for an approaching storm. Once removed, the fence sections 12, lockbars 14, and wingnuts 15 should be stored in an enclosed location. The fence 10 is preferably provided in a broad variety of styles, materials, and colors.

To use the first exemplary embodiment, the user inserts the lockbars 14 through the apertures 13 of a fencepost 11 and a fence section 12, and fastens the wingnuts 15 to the lockbars 14, in such a manner as to temporarily affix the end of the fence section 12 to the fencepost 11. A plurality of fenceposts 11 and fence sections 12 may be erected and joined in this manner to construct the fence 10.

The fenceposts 11 and the fence sections 12 are preferably manufactured from rigid, durable materials, such as aluminum alloy, plastic, steel, or wood. The lockbars 14 and the wingnuts 15 are preferably manufactured from a rigid, durable material with substantial structural strength, such as aluminum alloy, steel, or brass.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A removable fence comprising:

two or more fence posts, each of said fence posts comprising one or more post through-apertures therein, said post through-apertures extending in a first direction substantially transverse to a length of said one or more fence posts;

one or more fence sections extending between said two or more fence posts, wherein one or more fence through-apertures are disposed at lateral edges of said one or more fence sections, said fence through apertures extending in said first direction; and one or more L-shaped, threaded lockbars, wherein a threaded portion of each of said lockbars extends through said post through-apertures and said fence through-apertures in said first direction, thereby securing said fence posts to said fence sections.

2. The fence according to claim 1, further comprising one or more wingnuts engaged with said threaded portion of said lockbars.

3. The fence according to claim 1, wherein said post through-apertures and said fence through-apertures are disposed in sets of two apertures formed at top and/or bottom portions of said fence posts and said fence sections.

* * * * *